US005301616A

United States Patent [19]

Wacker et al.

[11] Patent Number: 5,301,616

[45] Date of Patent: Apr. 12, 1994

[54] REPOSITIONABLE PAPER STOP FOR A TABLE SURFACE

[75] Inventors: Robert W. Wacker, Plymouth; Dale M. Hemberger, Sheboygan, both of Wis.

[73] Assignee: Mayline Company, Inc., Sheboygan, Wis.

[21] Appl. No.: 7,501

[22] Filed: Jan. 22, 1993

[51] Int. Cl.[5] ..... A47B 17/00

[52] U.S. Cl. ..... 108/27; 108/1

[58] Field of Search ..... 108/1, 27, 55.3, 25, 108/26; 312/137

[56] References Cited

U.S. PATENT DOCUMENTS

| | | | |
|---|---|---|---|
| 702,035 | 6/1902 | Shaffer | 108/1 |
| 1,314,060 | 8/1919 | Hagerstrom | 108/27 |
| 4,437,411 | 3/1984 | Maxwell | 108/27 |
| 4,986,193 | 1/1991 | Steinhilber | 108/27 |

*Primary Examiner*—kenneth J. Dorner
*Assistant Examiner*—Gerald A. Anderson
*Attorney, Agent, or Firm*—Andrus, Sceales, Starke & Sawall

[57] ABSTRACT

A repositionable paper stop for the edge of the top surface of a table includes a long body having one flat planar side and another side having an upstanding edge portion which can be alternately repositioned in a groove in the top surface of the table between an inactive position with the flat planar side flush with the table surface and inactive position with the upstanding edge portion extending above the table surface to act as a conventional stop. The stop member can be manually displaced from either position by a slidable lift pin manually movable into the groove from below the table and into contact with the underside of the stop member in the groove.

8 Claims, 1 Drawing Sheet

REPOSITIONABLE PAPER STOP FOR A TABLE SURFACE

BACKGROUND OF THE INVENTION

The present inventions pertains to a paper stop or abutment for the edge of an inclined table or similar surface for preventing papers and similar materials from sliding off the surface and, in particular, to a repositionable paper stop which may be manually inverted to move from an active to an inactive position.

It is well known to provide inclined planar working surfaces, such as desks, tables, lecterns and the like with a raised lower edge portion to retain papers, books, writing implements and the like from sliding or rolling off the inclined surface. Many such paper stops or similar abutments are permanently attached to the edge of the planar surface and, as a result, sometimes interfere with the effective use of the surface, as for drawing or writing, by presenting an obstruction to the flush placement of the user's arms on the surface. As a result, it is known to provide the inclined or tiltable surface of a table, desk or the like with a movable or repositionable paper stop which can be moved between a paper retaining position and an inactive position where the stop does not extend above the inclined or tiltable surface.

U.S. Pat. No. 4,986,193 discloses a paper stop which is slidably mounted in a slot in the table top against the bias of compression springs which normally bias the stop bar upwardly into an active position above the surface of the table, but which may be manually depressed downwardly into the slot under the weight of the user's arm. An alternate embodiment provides a continuous elastically yieldable strip which is compressible under the weight of the user's arm.

U.S. Pat. No. 4,437,411 shows a paper stop which is movable vertically between flush and raised positions with respect to the table surface and in which the stop is held in either position by horizontal pins extending from the edge of the table through slots in the stop bar.

U.S. Patent No. 1,314,060 shows a stop bar in the form of a strip which is rotatably attached to the front edge of a drawing board or table for rotation about a center pivot to present either a top edge raised above the table surface or a top edge flush with the table surface.

The first above-identified patent requires the active engagement by the arms of the user to depress the paper stop, and the other two patents require special pinned connections to facilitate movement of the stop bar between its active and inactive positions. Further, the two last mentioned patents include stop bars which are attached to the front edge face of the table and, in their inactive positions, extend below the undersurface of the table.

SUMMARY OF THE INVENTION

In accordance with the present invention, a repositionable stop bar rests in a groove in the top surface of the table in an active position with an upstanding edge extending above the table surface and an inactive position to which it may be manually inserted with the upstanding edge extending downwardly into the groove and an upper surface flush with the table top surface.

In one embodiment, the repositionable paper stop comprises an elongate strip defining a body which includes one flat planar side and another side having an upstanding edge portion extending along at least part of the length of the body. Complimentary groove means in the surface of the table receives the strip in one position to support the strip with the flat planar side flush with the table surface and in another position to support the strip with the upstanding edge portion extending above the table surface and generally perpendicular to it. Preferably, the upstanding edge portion runs substantially the full length of the body. The body may be T-shaped in cross section with the upstanding edge portion on one side of the body opposite the flat planar side and extending generally perpendicular thereto. The groove is also preferably T-shaped in cross section to fully receive the body therein in the inactive position.

In the preferred embodiment of the present invention, the repositionable paper stop includes a long narrow strip having one side which defines a flat substantially planar surface and an opposite side which defines an upstanding stop edge between a pair of coplanar support surfaces. The stop edge extends generally perpendicular to the flat planar surface, and the support surfaces on either side of the upstanding stop edge lie parallel to the flat planar surface. A groove in the top surface of the table is shaped to receive and peripherally enclose the strip. The groove includes a pair of recessed shoulder surfaces which bear against the support surfaces on the strip and hold the strip with its flat planar surface flush with the table top surface when the strip is received in the groove in a first position and, when the strip is inverted to a second position, said shoulder surfaces bear against the flat planar surface and hold the strip with its support surfaces flush with the table top surface and the stop edge extending upwardly therefrom. The strip-receiving groove preferably includes a deepened central slot between the recessed shoulder surfaces so that the stop edge is received in the slot when the strip is in its first position. The central slot in the bottom of the groove preferably includes a bottom surface which is spaced from the under surface of the table, and the table is further provided with strip lifting means which extend through the bottom surface of the slot from the underside of the table and are manually movable in a vertical direction to engage the opposite side of the strip when it is in its first position for displacing the strip from the groove. One specific embodiment of the lifting means comprises a vertical through hole in the table between the under surface thereof and the bottom surface of the slot; a pin which is slidably positioned in the hole and held therein by a flanged head which engages the bottom surface of the slot; and, a manually engageable button on the lower end of the pin by which the pin may be raised to cause the upper flanged head to engage the stop edge extending downwardly into the slot.

DETAILED DESCRIPTION OF THE PREFERRED EMBODIMENT

Figure 1:
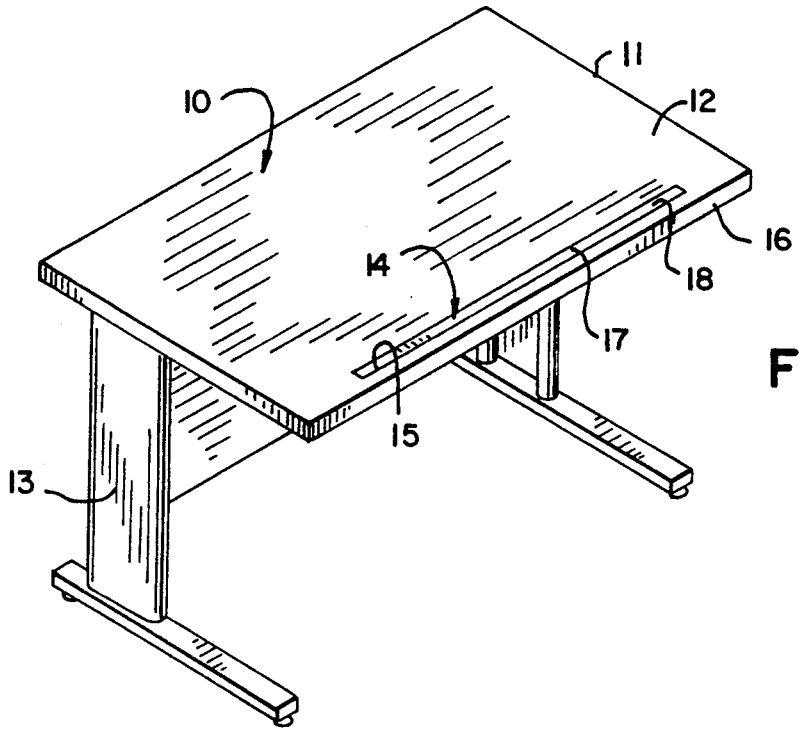
FIG. 1 is a perspective view of a tilt top table utilizing the repositionable paper stop of the present invention.

In FIG. 1, there is shown a conventional general purpose table 10 which includes a top 11 that is tiltable about a horizontal axis to vary the angle of the top surface I2. The supporting base I3 and mechanism for tilting the table may be of any conventional construction. The repositionable paper stop 14 of the present invention is adapted to lie in a long groove 15 cut into the top surface I2 of the table parallel to and closely spaced from the front edge 16 of the table top.

Figure 2:
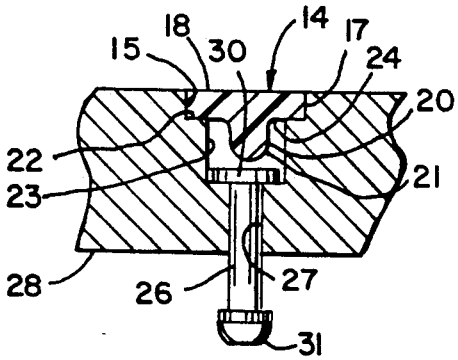
FIG. 2 is enlarged vertical section through the edge of the table and repositionable paper stop of FIG. 1 showing the paper stop in its inactive position flush with the table top.

Referring also to FIG. 2, the paper stop 14 has an elongate body 17 having a length substantially the same as the length of the groove 15. The stop body has a generally T-shaped cross section having a flat planar side 18 which is disposed flush with the top surface 12 of the table when the stop is positioned in its inactive position shown in FIGS. 1 and 2. The opposite side of the paper stop body 17 includes an upstanding edge portion 20 which runs the full length of the body and is generally perpendicular to the opposite flat planar side 18. The edge portion 20, which provides the paper stop function when in its active position, preferably has a rounded end 21 for the comfort of the user of the table.

The groove 15 in the table surface 12 is of a stepped construction and includes a pair of opposite shoulder surfaces 22 separated by a deepened central slot 23. The shoulder surfaces 22 engage a pair of support surfaces 24 which run the length of the body 17 of the paper stop on opposite sides of the upstanding edge portion 20. Engagement of the support surfaces 24 on the shoulder surfaces 22 of the groove position the paper stop 14 with the flat planar side 18 flush with the table surface 12, as shown in FIG. 2.

Figure 3:
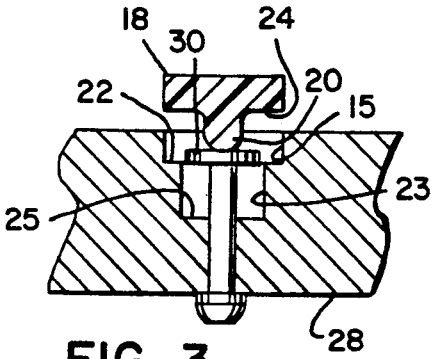
FIG. 3 is a view similar to FIG. 2 showing the means for manually displacing the paper stop from its inactive FIG. 2 position for movement to its reversed active position.
Figure 4:
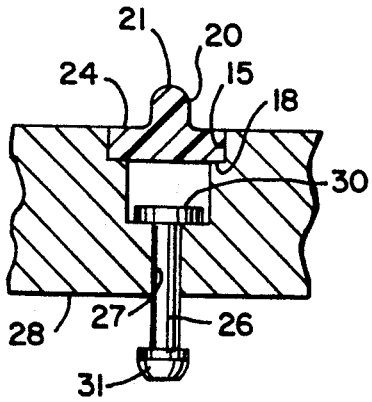
FIG. 4 is a view similar to FIGS. 2 and 3 showing the paper stop repositioned to its active position.

Referring also to FIGS. 3 and 4, the central slot 23 in the groove 15 has a bottom surface 25 spaced vertically below the rounded end 21 of the stop edge portion 20 when resting in the groove in the FIG. 2 position. A lifting pin 26 is disposed in a vertical through hole 27 extending between the table undersurface 28 and the bottom surface 25 of the central slot 23. The pin 26, which may comprise a conventional flat head rivet, is maintained in the through hole 27 by engagement of the flat head 30 of the rivet with the bottom surface 25. The lower end of the pin 26 is provided with a enlarged button head 31 to facilitate manual engagement by the user and to retain the lifting pin in the through hole 27. As is best seen in FIG. 3, the paper stop 14 is readily displaced and removed from its inactive flush position in FIGS. I and 2 by manually pushing the lifting pin 26 vertically upward, causing the flat head 30 to engage the rounded end 21 of the stop edge portion 20 and lift it from the groove 15. The lifting pin 26 is preferably positioned near one end of the groove 15 so that only the end of the paper stop I4 adjacent that end is lifted from the groove where it can easily be grasped by the hand of the user, inverted and replaced in the groove in the active position shown in FIG. 4 with the upstanding edge portion 20 positioned above the top surface I2 of the table. In the active FIG. 4 position, the flat planar side 18 of the paper stop rests on the shoulder surfaces 22 of the groove such that the support surfaces 24 of the stop lie flush with the table surface, thereby leaving only the rounded end edge portion 20 protruding above the table. In this position, the edge portion 20 acts as a conventional paper stop. If it is desired to return the paper stop from the active FIG. 4 position to the inactive FIG. 2 position, the user may utilize the lifting pin 26 to lift one end of the stop from the groove or, alternately, may simply grasp the edge portion 20 and lift it from the groove for inversion and reseating therein.

Figure 5:
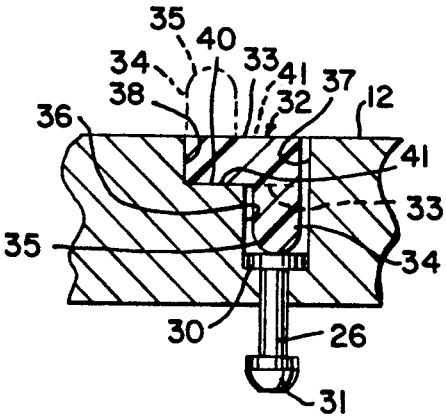
FIG. 5 is an enlarged sectional view similar to FIGS. 2–4 showing an alternate embodiment of the repositionable paper stop.

In FIG. 5, a modified paper stop 32 is L-shaped in cross section and, in the position shown, one flat planar side 33 lies flush with the plane of the table top 12 such that the other leg of the stop which includes an edge portion 34 with a rounded free end 35, extends into the corresponding lower end 36 of an L-shaped groove 37 in the table top. The upper end 38 of the L-shaped groove includes a single shoulder surface 40 which supports the flat face 41 of the leg including the flat planar side 33 while the rounded end 35 on the other leg 34 engages the flat head 30 of the lifting pin 26 (which may be identical to the pin used in the previously described embodiment).

The modified paper stop 32, shown in FIG. 5, is lifted from the groove 37 by manually raising the lifting pin 26 in the manner previously described. The stop 32 is then lifted from the groove 37, inverted, and replaced in the groove with the flat planar side 33 partially supported on the shoulder surface 40 in the upper end of the groove and the leg 34 comprising the stop edge extending upwardly from the table surface I2, as shown by the dashed lines in FIG. 5.

Various modes of carrying out the present invention are contemplated as being within the scope of the following claims particularly pointing out and distinctly claiming the subject matter which is regarded as the invention.

We claim:

1. A repositionable paper stop in an edge of a surface comprising:

an elongate strip having a body including one flat planar side and another side having an upstanding edge portion extending along at least a part of the length of the body; and, groove means in the surface for receiving the strip in one position to support said strip with the flat planar side flush with the surface and in another position to support said strip with the upstanding edge portion extending above the surface and generally perpendicular thereto.

2. The invention as set forth in claim 1 wherein the upstanding edge portion runs substantially the full length of the body.

3. The invention as set forth in claim 1 wherein said body is T-shaped in cross section and said upstanding edge portion is on the side of the body opposite said flat planar side and extends generally perpendicular thereto.

4. The invention as set forth in claim 3 wherein said groove means is T-shaped in cross section and dimensioned to fully receive said body therein in said one position.

5. A repositionable paper stop in an edge of a top surface comprising:

a long narrow strip having one side defining a substantially flat planar surface and an opposite side defining an upstanding stop edge between a pair of coplanar support surfaces, said edge extending generally perpendicular to said flat planar surface, and said support surfaces lying parallel to said flat planar surface;

a groove in the top surface shaped to receive and peripherally enclose said strip, said groove including a pair of recessed shoulder surfaces, which shoulder surfaces bear against said support surfaces and hold said strip with the flat planar surface flush with the top surface when said strip is received in said groove in a first position, and which shoulder surfaces bear against said flat planar surface and hold said strip with said support surfaces flush with the top surface and said stop edge extending upwardly therefrom when said strip is received in said groove in a second position inverted from said first position.

6. The repositionable paper stop as set forth in claim 5 wherein said groove includes a deepened central slot between said recessed shoulder surfaces and wherein said stop edge is received in said slot when the strip is in the first position.

7. The repositionable paper stop as set forth in claim 6 wherein said central slot includes a bottom surface spaced from the under surface of the table, and further comprising strip lifting means extending through a bottom surface of said central slot from an under surface and manually movable vertically to engage the opposite side of the strip in the first position for displacing the strip from the groove.

8. The repositionable paper stop as set forth in claim 7 wherein said lifting means comprises:

a vertical through hole in the under surface and the bottom surface of the slot;

a pin slidably positioned in the hole and held therein by an upper flanged head in engagement with the bottom surface of said slot; and, a manually engageable button on the lower end of the pin.

* * * * *